United States Patent [19]

Deisting

[11] 4,029,010

[45] June 14, 1977

[54] ELECTROMAGNETIC PRINTING DEVICE

[75] Inventor: Horst Gürgen Deisting, Berlin, Germany

[73] Assignee: Pitney-Bowes, Inc., Stamford, Conn.

[22] Filed: Jan. 23, 1976

[21] Appl. No.: 651,775

[30] Foreign Application Priority Data

Jan. 31, 1975 Germany ..... 2504017
Apr. 16, 1975 Germany ..... 2516808

[52] U.S. Cl. ..... 101/316; 101/369; 101/407 BP; 101/318

[51] Int. Cl.[2] ..... B41F 1/06

[58] Field of Search ..... 101/19, 287, 407 BP, 101/316–319, 324, 269, 369, 336; 197/151

[56] References Cited

UNITED STATES PATENTS

| | | | |
|---|---|---|---|
| 2,339,199 | 1/1944 | Smith | 101/19 X |
| 2,559,455 | 7/1951 | Meyer | 101/44 |
| 2,620,726 | 12/1952 | Tarkelson | 101/316 X |
| 2,801,583 | 8/1957 | Loushay | 101/316 X |
| 3,768,404 | 10/1973 | Holovka | 101/269 |
| 3,812,778 | 5/1974 | Ziska | 101/369 X |
| 3,828,664 | 8/1974 | Dikoff | 101/19 |

*Primary Examiner*—Edward M. Coven
*Attorney, Agent, or Firm*—Peter Vrahotes; William D. Soltow, Jr.; Albert W. Scribner

[57] ABSTRACT

This invention relates to a relatively small printing device for printing onto a printing assembly of the kind having at least one form and an ink transferring ribbon associated with it. The printing device is top loading and includes a flat printing pad and a printing anvil serving as a support for a printing plate, such as a credit card, and for the printing assembly. Also included is an electromagnetic impulse device which has at least one electromagnet and an armature plate connected to the printing anvil and by means of which a short impression impulse is exerted after the distance between the printing pad and the printing anvil has manually been reduced to virtually the distance corresponding to the thickness of the plate and the printing assembly.

8 Claims, 12 Drawing Figures

FIG. 1
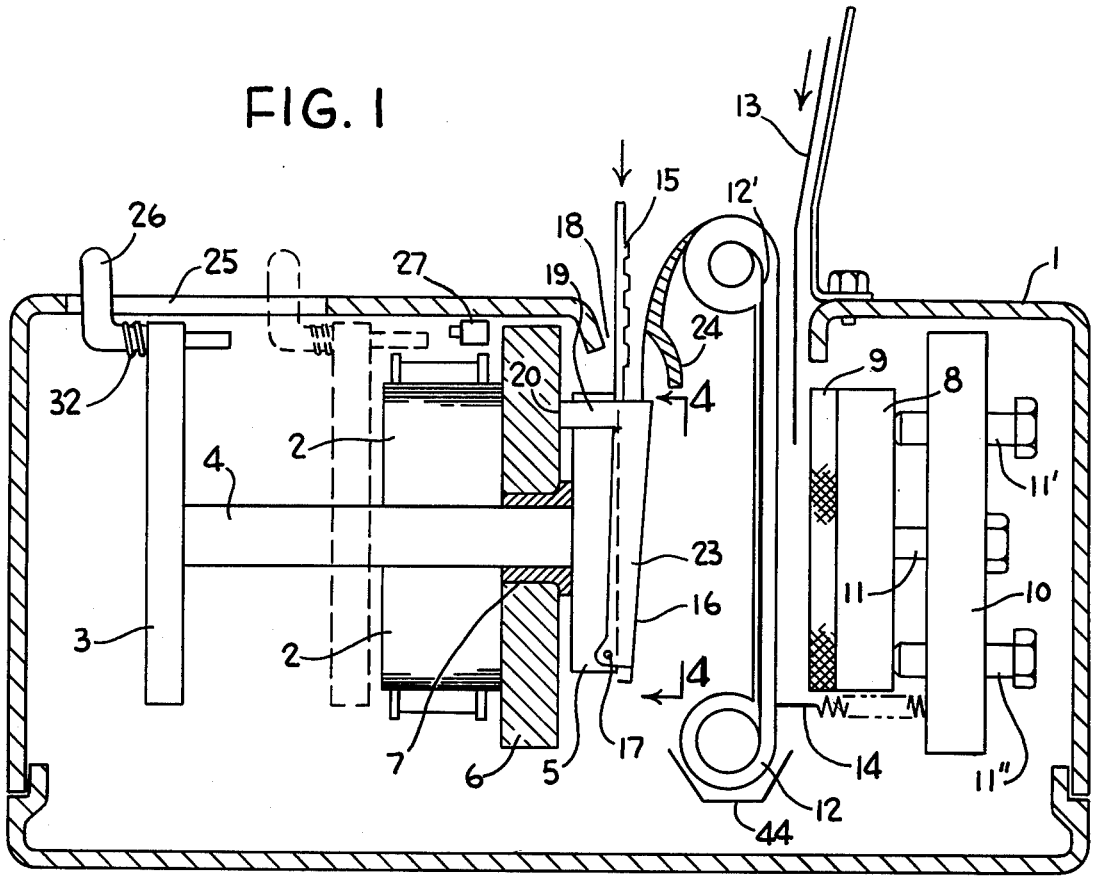
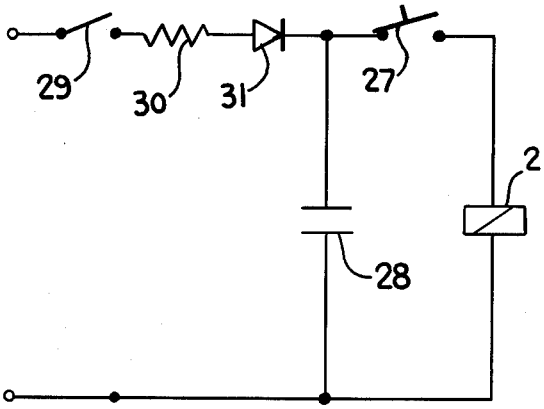
FIG. 2
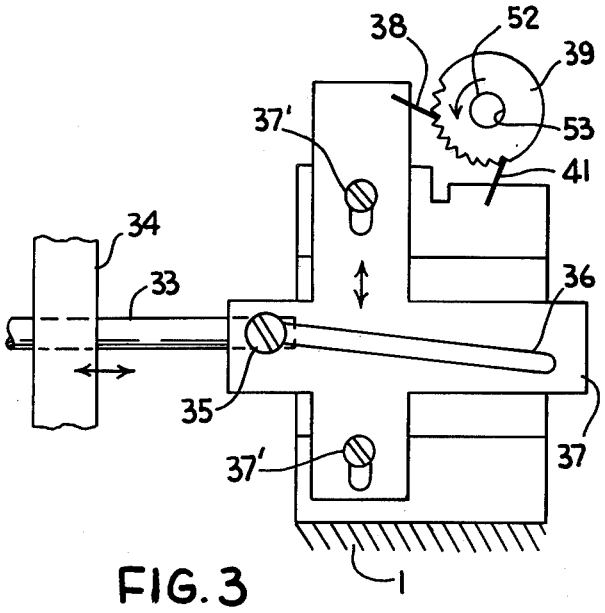
FIG. 3

FIG. 6
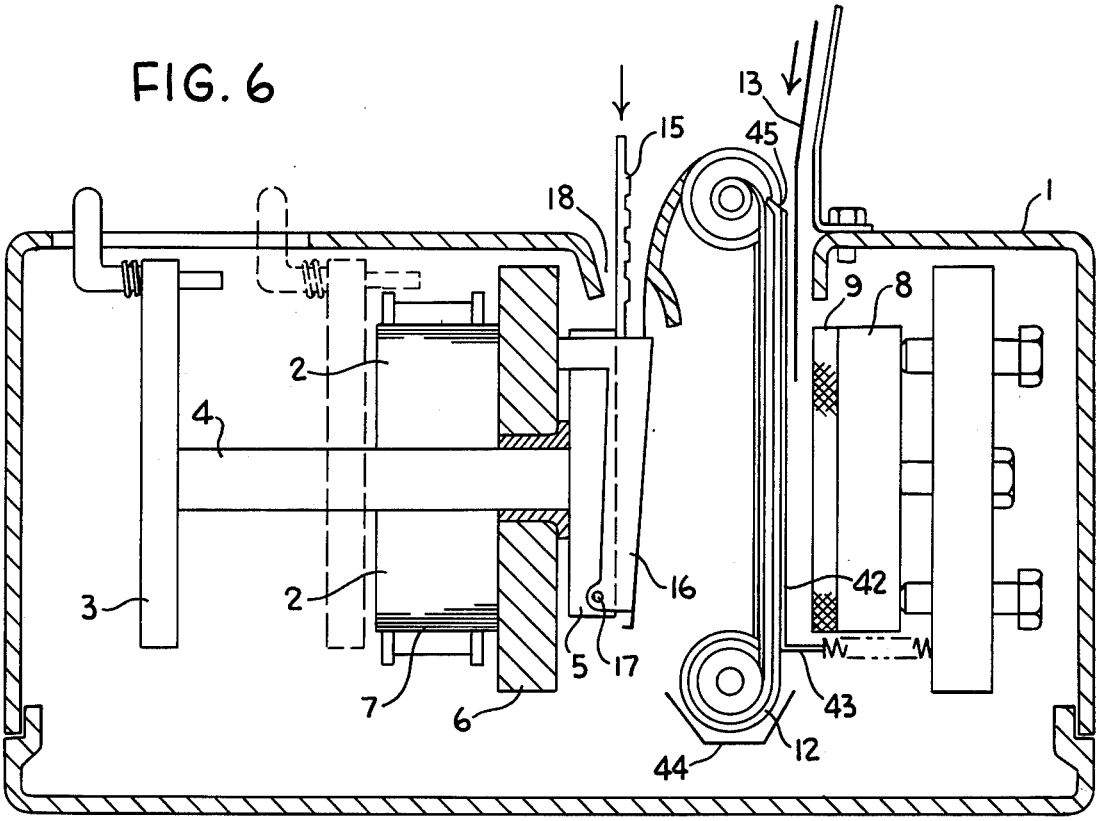
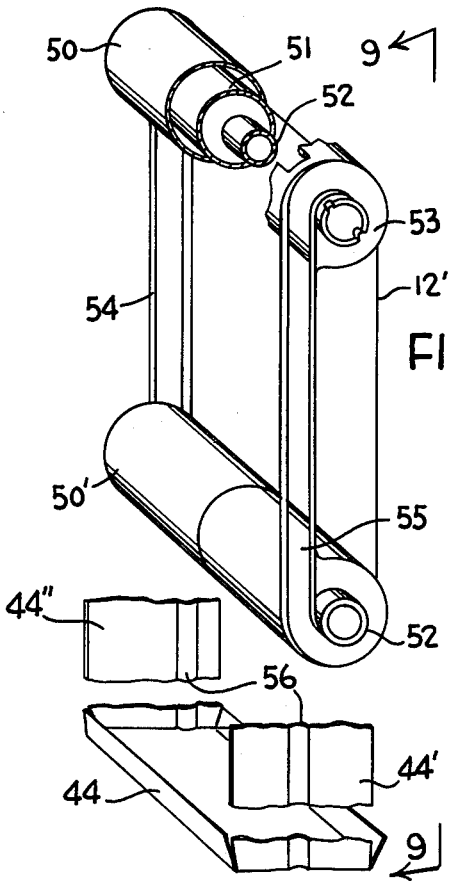
FIG. 8
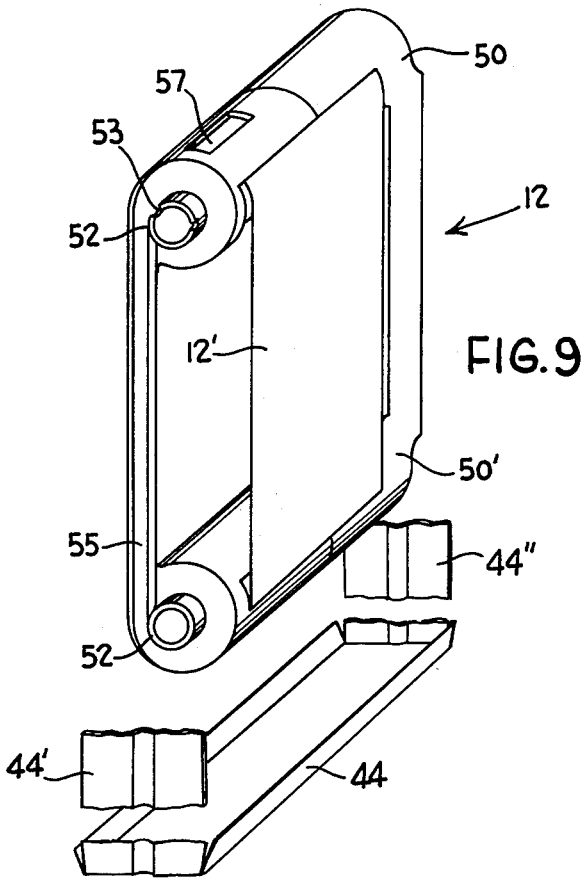
FIG. 9

ELECTROMAGNETIC PRINTING DEVICE

BACKGROUND OF THE INVENTION

This invention has application in the field of printing wherein the combination of printing plates, such as credit cards, and multi-layered form assemblies are used. The printing assemblies generally have at least one sheet of paper and a carbon and a printing impression is made on a sheet by impressing a printing plate against a printing assembly. For reducing the distance between the printing pad and the printing anvil and for printing with the application of only a minimum of power, in prior devices a guide mechanism is used, comprising either a toggle joint system or a cam, by means of which the printing pad and the printing anvil can be directed toward one another in the vertical direction. After the printing pad and printing anvil are placed adjacent one another, an electromagnetic lifting mechanism exerts a very short printing impulse on the printing assembly to complete the printing operation.

The printing plates in such devices are horizontally supplied to and from the printing station, as is customary in prior art address printing machines which do not include electromagnetic printing means. It would be advantageous with regard to each operation to have an electromagnetic printing device of the type heretofor described which can be loaded and unloaded vertically, i.e. from the top of the printing device.

SUMMARY OF THE INVENTION

This invention is an improvement over the printing devices utilizing a combination of mechanical and electromagnet printing means. A particularly small, compact and therefore low-priced device has been attained, which, in spite of being manually operated, results in exact imprints which yield machine readable impressions.

For the obtaining of the above mentioned benefits, the printing device of the instant invention has the printing anvil, together with the armature plate connected to it, slidably mounted so as to be horizontally moved by hand from a first position, in which position the printing plate as well as the printing assembly can be vertically fed into the housing, to a forward position, in which the printing anvil is located directly in front of the printing pad and the interposed printing assembly. Additionally, when in the forward position, the armature is located directly in front of the magnet and therewith in the impulse readiness position.

It has been found advantageous in such printing devices to provide a capacitor which triggers the printing impulse through the electromagnet, when a switch is closed, to drive the armature plate, which is connected to the printing anvil. A handle extends through an aperture in the housing to enable the manual shifting of the armature plate and the printing anvil connected to it. A switch is located at the end of the path of this handle so as to be closed thereby. It has been found advantageous to mount this handle on the armature plate so as to be axially movable against the effect of a spring and to arrange the switch so as to be closable only after the spring has been compressed by the handle. In such a construction of the printing device, the printing anvil together with the plate can be moved into the printing position by hand under application of only a minimum of power, and a slight shifting of the handle compressing the associated spring is sufficient for actuating the switch and therefor triggering the printing impulse.

It has been found advantageous, with regard to ease of printing operation, to provide a holding frame for supporting the plates. The frame is pivotally mounted on the printing anvil so as to be pivoted about a lower horizontal axis in such way so that an opening slot for insertion or removal of the printing plates is provided when the frame is pivoted in the direction away from the printing anvil.

BRIEF DESCRIPTION OF THE DRAWINGS

Other details, advantages and characteristics of this invention will become apparent from the following description and by reference to the accompanying figures of the drawing wherein like numbers designate like parts:

FIG. 1 is a longitudinal, cross-sectional view of a printing device incorporating the features of the instant invention;

FIG. 2 is a circuit diagram of the electrical circuit provided to the printing device shown in FIG. 1;

FIG. 3 is a detailed view of a ratched device for feeding an ink ribbon within the printing device shown in FIG. 1;

FIG. 6 is a longitudinal, cross-sectional view of an alternate embodiment of the printing device of FIG. 1;

FIG. 8 is an exploded view of the ink ribbon box used in the printing device shown in FIGS. 1 and 6 and taken along the lines 8—8 of FIG. 7; and FIG. 9 is another exploded view of the ink ribbon box of FIGS. 1 and 2 taken along the lines 9—9 of FIG. 8.

DETAILED DESCRIPTION OF THE PREFERRED EMBODIMENTS

Figure 4A:
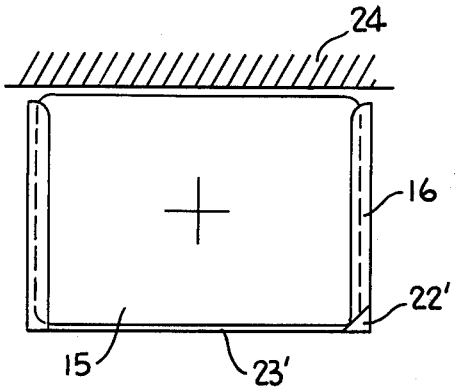
FIGS. 4*a* and 4*b* are front views illustrating details of construction and taken along the line 4—4 of FIG. 1.

Referring now to FIG. 1, the printing device illustrated therein has an elongated housing 1. Located within the housing 1 are two opposed electromagnets 2 with which an armature plate 3 is associated. This armature plate 3 is connected to a printing anvil 5 by means of a central rod 4. The central rod 4 slidably extends through a horizontal sleeve bearing 7 which is mounted in a vertical support 6 and which extends into the area between the electromagnets 2. A printing pad 9 is arranged in front of the printing anvil 5 and is mounted on a printing pad carrier 8. For this purpose, a vertical support 10 of the housing is arranged to be connected to the printing pad carrier 8 by means of a screw 11. Set screws 11′, 11″, allow exact adjustment of the printing pad 9 with respect to the printing anvil 5.

Located in the space between the printing anvil 5 and the printing pad 9 is an ink ribbon box 12 which contains an ink ribbon 12′. In order to drive the ink ribbon 12′, receiving lugs 52 are mounted in the ink ribbon box 12 and one receiving lug is coupled with a ratchet wheel 39. The manner in which one of the receiving lugs 52 cooperates with a ratchet device will be described hereinafter in conjunction with FIG. 3.

Within an opening 18 between the ink ribbon box 12 and the printing pad 9, a document 13, or printing assembly, may be inserted from above. The printing assembly 13 will normally include at least one sheet of paper, and at least one carbon paper. Alternatively, an ink encapsulated self printing form may be used. The vertical movement of this printing assembly 13 is in the direction as indicated by the arrow shown in FIG. 1 and the assembly is supported by a spring loaded bar 14 mounted upon the vertical support 10. In this way, an exact positioning of the assembly 13 is assured.

Figure 7:
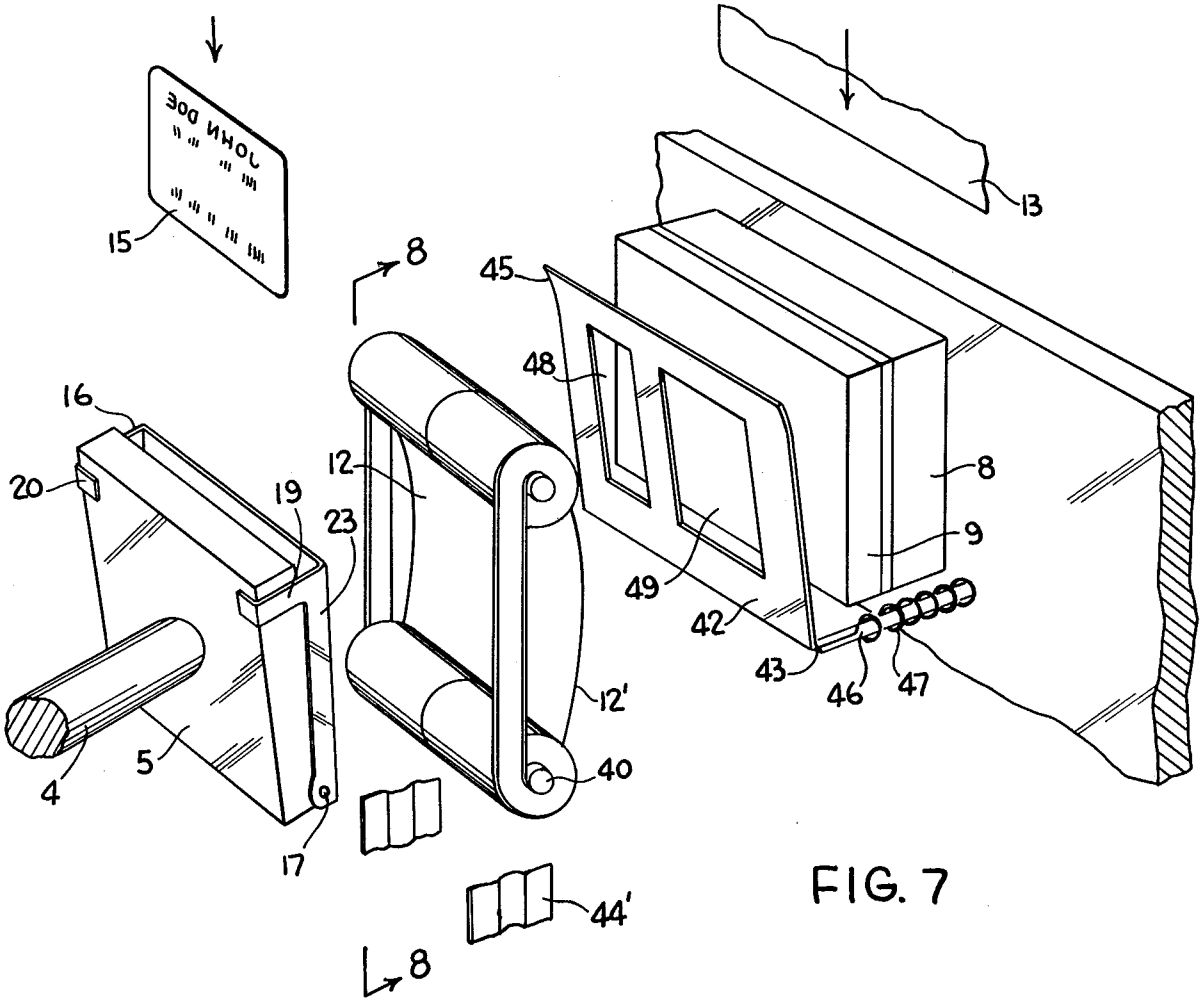
FIG. 7 is an exploded, perspective view of the printing device shown in FIG. 6.

Still referring to FIG. 1, a holding frame 16 serves as a support for a plate 15 and is pivotally mounted on a laterally extending pin 17 which is secured to the printing anvil 5. When the holding frame 16 is pivoted away from the printing anvil 5, it forms an upward opening slot for the insertion or removal of a plate 15 which corresponds to the insertion opening 18 at the top of the housing 1. The holding frame 16 has an L-shaped wall 23 for laterally engaging the plate 15 and supporting the same at its bottom edge. These walls 23 terminate at their upper ends into struts 19 which are generally perpendicular to the vertical support 6. These side walls 23 of the holding frame 16 extend along both sides of the printing anvil 5 and are operatively connected therewith through the struts 19 and traversely extending members 20 which are adjacent the vertical support 6. The traverse members 20 limit the extent of pivotal movement by the frame 16 through engagement with the printing anvil 5 as can be seen in FIG. 7.

Figure 5A:
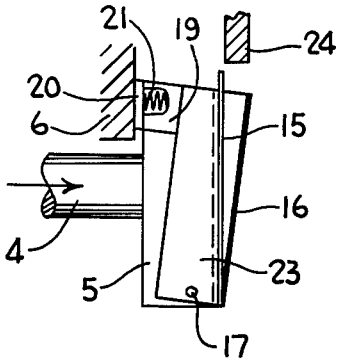
FIGS. 5*a* and 5*b* are detailed longitudinal views illustrating the mode of holding a printing plate in the printing device shown in FIG. 1.
Figure 5B:
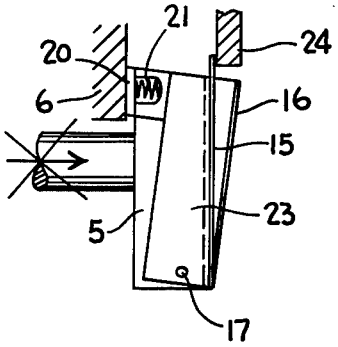

As can be seen in FIGS. 5*a* and 5*b*, a spring 21 is arranged between each traverse member 20 and the printing anvil 5 and is mounted within a bore of the printing anvil 5. In the position of the printing anvil 5, with regard to the vertical support 6, as illustrated in the FIGS. 5*a* and 5*b* the traverse members 20 engage the printing anvil 5. Consequently, the spring 21 is compressed and the holding frame 16 pivoted around the lower horizontal pins 17 to form an opening slot for the insertion or removal of the plate 15.

Figure 4B:
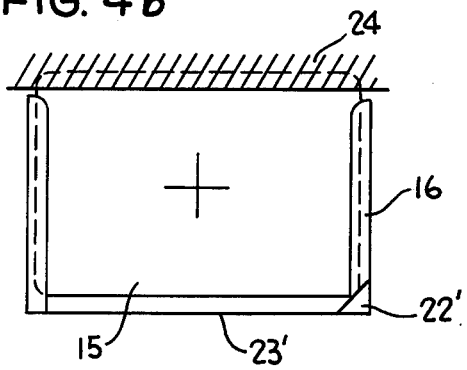
Figure 4C:
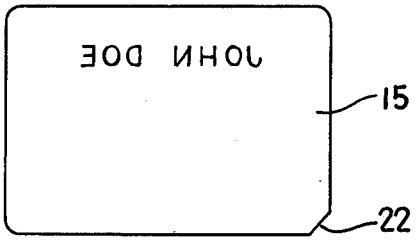
FIG. 4*c* is a plane view of a printing plate which may be used with the device shown in FIG 1.

As can be seen in FIG. 4*c*, each printing plate 15 is provided at its bottom edge with a bevel 22. A corresponding limiting pin 22′ is arranged at the lower part of the frame 16 and together with the bevel 22, assures an exact positioning of the plate 15. As illustrated in FIGS. 4*a* and 5*a*, the plate 15 engages the lower portion of wall 23 of the frame 16 only if the bevel 22 of the plate 15 is in alignment with the limiting pin 22′. In the case where the plate 15 is incorrectly inserted into the holding frame 16, as shown in the FIGS. 4*b* and 5*b*, i.e. turned 180°, one of the corners of the plate abuts the limiting pin 22′ and the plate is suspended above the holding frame 16. Forward movement of the printing anvil 5 in the direction as indicated by the arrow shown in the FIGS.4*d* or 5*b* is prevented by the presence of a projection 24 which extends from the housing. The upper edge of the plate 15 would be engaged by the projection 24 if the plate is not properly seated within the frame 16.

The central rod 4 is arranged in such a manner that the armature plate 3 will be located directly in front of the electromagnets 2 when the printing anvil 5, together with the plate 15, is moved into virtual engagement with the printing pad 9. In order to be moved manually, under application of only a minimum of power, into the position as indicated by the dotted lines illustrated in FIG. 1, the armature plate 3 is provided with a handle 26 which extends outwardly through an opening 25 of the housing 1. A switch 27 is arranged in the path of movement of this handle 26, the switch preferably being a mercury switch.

As is shown in FIG 2, the switch 27 is connected through the electromagnets 2 to a discharging circuit having a capacitor 28 (not shown in FIG. 1) which is charged by a source of power through a switch 29, a resistor 30 and a rectifier 31. The handle 26 is axially and slidably mounted on the armature plate 3 so as to be moved against the effect of the force of a spring 32 which holds the handle within the armature plate. When the handle, together with the armature plate 3, the central rod 4, and the printing anvil 5, has been moved into the position as illustrated by the dotted lines in FIG. 1, further pushing on the handle 26 causes a compression of the spring 32 and subsequently the closing of the switch 27 which is arranged in the path of movement of the handle 26. The closing of the switch causes the discharging of the capacitor, thereby enabling the electromagnets 2. This will result in the printing anvil 5 being impacted against the printing pad 9 to complete the printing operation.

The unit comprising the armature plate 3, the central rod 4 and the printing anvil 5 is connected to a horizontally extending push rod 33 (shown in FIG. 3) which actuates a ratchet device associated with the ink ribbon box 12. The push rod 33 is slidably received within a portion 34 of the housing in such a manner that a longitudinal deviation is prevented. The push rod 33 is provided at its outer end with a pin 35 which extends through an inclined slotted hole 36 of an engaging member 37. This engaging member 37 is vertically guided by pins 37′ which are supported by the housing 11 and is provided with a leaf spring 38 which engages a ratchet wheel 39 mounted on a lug 52 of the ink ribbon box 12. A second leaf spring 41 is supported by the housing 11 and prevents reverse rotation of the ratchet wheel 39 in the direction as indicated by the arrow illustrated in FIG. 3.

From the aforementioned description it will be appreciated that a printing device according to this invention is not only characterized by small and inexpensive construction, which is moreover easy to operate, but will produce only a minimum of noise. Additionally, sets of assemblies with different thicknesses can be printed without an adjustment of the force of impression. Furthermore, the imprints will be obtained on predetermined areas of the assemblies, based on the one hand on the vertical arrangement of the plate holding device, thereby resulting in an automatic support of the plates after they have been inserted in the holding frame of the printing anvil, and on the other hand on the precise support of the forms on the spring loaded bar 14. Accurate and uniform machine readable impressions can be attained by using an ink ribbon box, which use eliminates smudging of the fingers of the operator. Appropriately, the ink ribbon box 12 may be made out of a transparent material so that a mark placed near the end of the ink ribbon 12′ can be seen by the operator.

An alternate embodiment is shown in FIGS. 6 and 7. The ink ribbon box 12 and printing assembly 13 are insertable from the top into the interior of the housing 11 between the printing anvil 5 and the printing pad 9. Arranged in the gap between the printing anvil 5 and the printing pad 9 are the ink ribbon box and an elastic mask 42. The mask 42 is arranged between the printing pad 9 and the ink ribbon box 12. The assembly 13, moreover, is insertable through the opening 19, in the direction of the arrow, between the mask 42 and the printing pad 9. In order to determine the exact printing position of the assembly 13, the mask 42 is provided at its lower end with a flange 43 which extends under the printing pad 9.

The ink ribbon box 12 can be inserted in the device from the top in the same manner as the assembly 13 and the plate 15 (compare the arrows in FIG. 6). The inserting movement of the ink ribbon box 12 is limited therewith by means of a trough 44 which is disposed in the housing and provided with conically extending walls 44'. The opening 18 of the housing 1 receives a depending member 24 which is shaped so as to form an upper supporting means for the ink ribbon box 12. The ink ribbon box 12 is kept in engagement to this supporting means 24 by means of the mask 42. The mask 42 is provided with a bending portion 45 at its free end which engages the ink ribbon to form a suitable insertion opening for the assembly 13. FIG. 7 shows in an exploded view the essential arrangement of the respective parts. A bottom flange 43 of the mask 42 rests on a supporting bar 46 and a spring 47 acts on the mask in the direction of the ink ribbon box 12. The bottom flange 43 is formed at an angle of more than 90°. The mask is made of an elastic material, as, for instance, bronze sheet metal. The top of the mask 42 is provided with a bent portion 45, which engages the ink ribbon box 12 and may extend into a slot in the upper cylinder 50 of the ink ribbon box. The mask 42 is furthermore provided with two apertures 48 and 49 of which the first aperture 48 enables the printing of a printing block which is stationarily mounted in the device and contains standard data thereon. The other aperture 49 enables the printing of the data of the plate 15.

From the FIGS. 8 and 9 details of the ink ribbon box 12 and its guidance and support within the trough 44 can be seen. The ink ribbon box 12 has two cylinders 50 and 50' extending parallel to each other in which the respective rolls 51 of ink ribbon are received. The receptive rolls 5' are disposed about the receiving lugs 52 which extend outwardly through the cylinders 50 and 50' and of which at least one is provided with radial notches 53 for feeding the ink ribbon 12' by engagement with the ratchet wheel 39. The cylinders 50 and 50' are connected to each other through flanges 54 and 55 which are formed as U-shaped bars with legs that extend outwardly, i.e. in the direction away from the cylinders 50 and 50'. The side walls 44' and 44'' of the trough 44 extend upwardly and are provided with guide grooves 56 which engage the U-shaped bars of the flanges 54 and 55. The flanges 54 and 55 are staggered i.e. one of the vertical flanges is arranged on the side of the plane determined by the cylinder axis which face the mask 42 and the other on that side of the plane which faces the printing anvil 5.

The housing of the ink ribbon box 12 may be formed of two indentical parts to reduce the costs for manufacturing. The ink ribbon box 12, as indicated previously, may be made out of transparent material, so that the approach of the end of the ink ribbon 50 can be detected. Instead of the transparent material, metal can be used for the manufacturing of the ink ribbon box 12. In this case, the upper cylinder 50 is provided with a window 57 which enables the operator to detect the end of the ink ribbon 12'.

What is claimed is:

1. A printing device of the type where a printing plate, such as a credit card, is used to imprint upon a printing assembly, the combination comprising:

a longitudinal housing having a laterally extending first opening and a second opening longitudinally spaced relative to one another;

a longitudinally extending support rod slidably supported in said housing intermediate the longitudinal location of said openings;

a printing anvil secured to one end of said rod and having a flat surface generally in alignment with said first opening;

means for holding a printing plate adjacent to said printing anvil flat surface;

an armature plate secured to the second end of said rod in general alignment with said second opening;

a handle resiliently secured to said armature plate and having a portion which extends through said second opening whereby said rod may be manually slid within said housing toward said first opening;

an electromagnet securedly disposed within said housing intermediate said printing anvil and said armature plate:

a switch secured within said housing in general alignment with said handle whereby said switch is engageable by said handle to be closed thereby as said rod is slid within said housing toward said first opening;

means for enabling said electromagnet upon the closing of said switch thereby causing said armature plate to operatively engage said electromagnet;

a printing pad disposed within said housing and having a flat surface opposed to said flat surface of said printing anvil;

means disposed within said housing at said first opening for supporting an ink ribbon intermediate said printing anvil and said printing pad; and means for holding a printing assembly intermediate said printing anvil and said printing pad.

2. The printing device of claim 1 wherein said means for holding a printing plate includes a frame member pivotably secured to the bottom of said anvil, said frame having means for receiving a printing plate, an aperture to expose the printing plate to said printing pad and means for limiting the extent of pivoting relative to said printing anvil.

3. The printing device of claim 2 wherein said receiving means has a limiting member with a surface positioned to abut a bevelled corner of a printing plate.

4. The printing device of claim 1 including a mask secured within said housing adjacent to the flat surface of said printing pad, said mask having a pair of apertures therein, one of said apertures being aligned with said plate holding means.

5. The printing device of claim 1 wherein said means for enabling said electromagnet includes a circuit having first and second electrical paths in connection with one another; said first electrical path having a capacitor connected to said switch and to said electromagnet; and said second electrical path having a selectively operable source of power, a resistor and a diode operatively connected to one another.

6. A printing device of the type where a printing plate, such as a credit card, is used to imprint upon a printing assembly, the combination comprising:

a longitudinal housing having a laterally extending first opening and a second opening longitudinally spaced relative to one another;

a longitudinally extending support rod slidably supported in said housing intermediate the longitudinal location of said openings;

a printing anvil secured to one end of said rod and having a flat surface generally in alignment with said first opening;

means for holding a printing plate adjacent to said printing anvil flat surface;

an armature plate secured to the second end of said rod in general alignment with said second opening;

a handle resiliently secured to said armature plate and having a portion which extends through said second opening whereby said rod may be manually slid within said housing toward said first opening;

an electromagnet securedly disposed within said housing intermediate said printing anvil and said armature plate;

a switch secured within said housing in general alignment with said handle whereby said switch is engageable by said handle to be closed thereby as said rod is slid within said housing toward said first opening;

means for enabling said electromagnet upon the closing of said switch thereby causing said armature plate to operatively engage said electromagnet;

a printing pad disposed within said housing and having a flat surface opposed to said flat surface of said printing anvil;

a mask secured within said housing adjacent to the flat surface of said printing pad, said mask having a pair of apertures therein, one of said apertures being aligned with said plate holding means;

means disposed within said housing at said first opening for supporting an ink ribbon intermediate said mask and said printing plate; and means for holding a printing assembly intermediate said printing anvil and said printing pad.

7. The printing device of claim 6 wherein said means for holding a printing plate includes a frame member pivotably secured to the bottom of said anvil, said frame having means for receiving the printing plate, and aperture to expose the printing plate to said printing pad and means for limiting the extent of pivoting relative to said printing anvil.

8. The printing device of claim 7 wherein said receiving means has a limiting member having a surface positioned to abut a bevelled corner of a printing plate.

* * * * *

UNITED STATES PATENT AND TRADEMARK OFFICE

CERTIFICATE OF CORRECTION

PATENT NO. : 4,029,010

DATED : June 14, 1977

INVENTOR(S) : Horst Gurgen Deisting

It is certified that error appears in the above-identified patent and that said Letters Patent are hereby corrected as shown below:

Title page, column 1, line 4, change "[73] Assignee: Pitney-Bowes, Inc., Stamford, Conn." to -- [73] Assignee: -- Adrema Pitney Bowes GmbH, Heppenheim, Germany --.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*